US006471911B1

(12) United States Patent
Pleschiutschnigg et al.

(10) Patent No.: US 6,471,911 B1
(45) Date of Patent: Oct. 29, 2002

(54) METHOD AND DEVICE FOR SEALING A TAP HOLE IN METALLURGICAL CONTAINERS

(75) Inventors: Fritz-Peter Pleschiutschnigg, Duisburg; Wei-Ping Wu, Erkrath, both of (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/719,113

(22) PCT Filed: Jun. 10, 1999

(86) PCT No.: PCT/EP99/03993

§ 371 (c)(1),
(2), (4) Date: Jun. 18, 2001

(87) PCT Pub. No.: WO99/66082

PCT Pub. Date: Dec. 23, 1999

(30) Foreign Application Priority Data

Jun. 12, 1998 (DE) ..... 198 26 085

(51) Int. Cl.[7] ..... C21B 7/12

(52) U.S. Cl. ..... 266/45; 266/272; 222/590; 222/597

(58) Field of Search ..... 266/271, 272, 266/45; 222/597, 590, 591

(56) References Cited

U.S. PATENT DOCUMENTS

| | | | | |
|---|---|---|---|---|
| 4,173,299 A | | 11/1979 | Kollberg et al. | 222/594 |
| 4,399,986 A | * | 8/1983 | Collins | 266/272 |
| 4,715,585 A | | 12/1987 | Simko | 266/272 |
| 4,828,226 A | * | 5/1989 | Komaneckey | 266/272 |

FOREIGN PATENT DOCUMENTS

| | | | | |
|---|---|---|---|---|
| EP | 0315311 | | 5/1989 | |
| FR | 2472959 | | 7/1981 | |
| GB | 2091396 | * | 7/1982 | 266/272 |
| NZ | 280990 | | 11/1997 | |
| WO | 9718050 | | 5/1997 | |

OTHER PUBLICATIONS

Patent Abstracts of Japan, vol. 007, No. 108 (C–165), May 11, 1983 & JP 58 031018 A (Nitsushin Seikou KK), Feb. 23, 1983.

Patent Abstracts of Japan, vol. 007, No. 108 C–165), May 11, 1983 & JP 58 031019 A (Nitsushin Seikou KK), Feb. 23, 1983.

* cited by examiner

*Primary Examiner*—Scott Kastler
(74) *Attorney, Agent, or Firm*—Friedrich Kueffner

(57) ABSTRACT

In a method for sealing a tap opening in a metallurgical container a plug with a plug sleeve and a refractory flowable material is provided having a metal rod or pipe surrounded by a protective pipe connected thereto. The plug sleeve and the protective pipe are made of a material resistant to a molten mass of metal in the metallurgical container only for a short period of time. The material is a temporarily heat-insulating material which cokes within the molten mass of metal and is cardboard or wood. The time of introduction of the plug sleeve is controlled based on measured parameters of the molten mass. The plug is introduced into the tap opening by guiding the plug with the metal rod or pipe through the molten mass in the metallurgical container. The plug sleeve changes by temperature action of the molten mass of metal such that the flowable material is distributed in the tap opening and seals the tap opening. The tap opening is then closed from the exterior of the metallurgical container and the plug sleeve in the tap opening as well as the protective pipe are coked and destroyed.

17 Claims, 4 Drawing Sheets

METHOD AND DEVICE FOR SEALING A TAP HOLE IN METALLURGICAL CONTAINERS

BACKGROUND OF THE INVENTION

1. Field of the Invention

The invention relates to a method and a device for sealing a tap hole in metallurgical containers.

2. Description of the Related Art

The invention relates to a method and a device for sealing a tap hole in metallurgical containers.

Recently, there has been a tendency to produce steels of a high degree of purity, so-called clean steel, in order to thus fulfill the increasing requirements for improved steel properties. The separation of molten mass and slag in the electric furnace or converter with subsequent secondary metallurgy is an essential influencing factor with respect to the degree of purity.

From the prior art several tapping systems are known. In a conventional electric arc furnace tapping is carried out, for example, by lateral tilting of the furnace vessel. The furnace is tilted toward the tapping side for tapping, and the outflow of the molten mass is terminated by a fast return tilting after reaching the desired tapping weight. In this connection, it cannot be avoided that slag flows partially with the stream of the molten mass out of the tap hole.

After termination of tapping and the return tilting movement, the tap opening is prepared for a new batch in that the opening is closed by a closure plate and sand is filled into the opening. The sand filling process is carried out either manually or by an automated conveying system. An optimal filling of the opening with sand is not possible for a manual filling process. Moreover, this step, in the case that cleaning work has to be carried out, is time-consuming and labor-intensive.

Moreover, the slag-poor tapping system for a converter is known in connection with a float or slag stopper. In this context, a float whose specific weight is between that of the molten mass of steel and of the slag is introduced into the molten bath above the eddy caused by the outflowing molten mass. The float is lowered together with the outflowing molten mass of steel and closes the tap opening. A disadvantage is, however, that the sealing of the tap opening depends only on the lowered molten mass/slag interface and cannot be influenced otherwise. Moreover, a completely slag-free outflowing of the molten mass is not possible with this float solution.

For tapping in ladles, the so-called AMEPA system is known. This system is primarily employed for controlling the tapping from the ladle into the distributor of a continuous casting device. This is a tapping system according to the electromagnetic principal. The termination of tapping and the separation between molten mass and slag are achieved by a sensor which is mounted within the outflow of the ladle outlet. A slide system is provided which closes off the tap opening after it has been determined that slag also flows out. A slag-free tapping is not possible by this solution because the sensor reacts only after a portion of the slag has already flown through the opening.

Moreover, a pneumatic tapping system is known in the prior art which closes the metallurgical container from the exterior. However, this entails a great splashing risk.

From German patent DE 33 27 671 a device for a substantially slag-free tapping of the molten mass of metal, in particular, of molten mass of steel, from metallurgical containers is also known. This document concerns primarily the object of preventing turbulence generation during an immersion process of a closing member and thus a mixing of the slag and the molten mass. For this purpose, a closing member is suggested which can be moved by means of a liftable and lowerable rod via a lifting system into the metallurgical container. The lowering of the flow member and its securing shortly above the bottom of the container above the tap opening results in a better binding of the negative potential turbulences. It is described that the type of flow member for reducing turbulence can also be completely lowered into the tap opening at the container bottom in order to thus terminate the tapping. However, when doing so, the flow member is not completely received by the tap opening but is seated on the opening. In all of the aforementioned tapping methods of the prior art only a slag-poor, but not a slag-free, tapping is possible. This means, inter alia, that the oxygen contents in the molten mass is increased by the entrained oxide slag which entails an increased deoxidation. The oxygen contents of the FeO in the slag makes the desulfurization and degassing more difficult.

Finally, from EP 0 315 311 B1 a plug for closing the tap opening in metallurgical containers is known. This plug is comprised of a cylindrically shaped container of metal which at its ends is provided with two plates. The end which is facing into the interior of the container for mounting of the container and the corresponding inner plate are arranged so as to be spaced by a gap relative to one another. The metallic container receives refractory material such as, for example, sand. This sand is enclosed by a plastic foil. The plug is provided with a plunger with which, after placing the plug into the tap hole, it is achieved that the outer plate is moved against the inner plate along a linkage which penetrates the sand mass. Accordingly, the plastic foil is torn. This process is enhanced by an edge area of the container provided with teeth. The sand exits from the gap and flows into the intermediate space between container and outflow opening and thus provides a sealing connection. Subsequently, the plunger is removed while the metallic container remains within the tap hole.

SUMMARY OF THE INVENTION

The present invention has accordingly the object to provide a method and a tapping system with which in a simple and inexpensive way a slag-free tapping of a metallurgical container can be performed so that steels of a high degree of purity can be produced.

This object is solved according to the invention in regard to the method by controlling the time of introduction of the plug which comprises a plug sleeve as well as a core of a refractory flowable material, closing off the tap opening from the exterior of the container, and changing the consistency and/or shape of the plug sleeve by temperature action such that the flowable material is distributed in the tap opening in a sealing fashion and in regard to the device in that the plug comprises a plug sleeve fitting the tab opening as well as a core of a refractory flowable material, that the plug sleeve itself is comprised of a material which is resistant relative to the molten mass of metal only for a short period of time with respect to its consistency and/or shape.

The core of the invention is the provision of a tapping plug system with which the tap opening of a metallurgical container can be optimally sealed. This is achieved according to the invention by a special configuration of the plug. According to the method of the invention it is suggested to control the time of introduction of the plug into the tap opening, for example, as a function of the weight of the tapped steel, of the bath level, or by means of a slag detection system. Preferably, automatic but also semiautomatic or manual controls are possible. The time of introduction can be controlled point-by-point or, for example, by means of a signal which is determined by means of visual sensing or by means of a monitor indicator.

SUMMARY OF THE INVENTION

The present invention has accordingly the object to provide a method and a tapping system with which in a simple and inexpensive way a slag-free tapping of a metallurgical container can be performed so that steels of a high degree of purity can be produced.

This object is solved according to the invention in regard to the method by controlling the time of introduction of the plug which comprises a plug sleeve as well as a core of a refractory flowable material, closing off the tap opening from the exterior of the container, and changing the consistency and/or shape of the plug sleeve by temperature action such that the flowable material is distributed in the tap opening in a sealing fashion and in regard to the device in that the plug comprises a plug sleeve fitting the tab opening as well as a core of a refractory flowable material, that the plug sleeve itself is comprised of a material which is resistant relative to the molten mass of metal only for a short period of time with respect to its consistency and/or shape.

The plug according to the invention is comprised of a plug sleeve which receives a flowable material. This filled plug sleeve is introduced into the tap opening through the liquid metal or from the exterior of the metallurgical container. Subsequently, the tap opening is closed, for example, by means of the closure plate. The invention takes advantage of the fact that the material of the plug sleeve with respect to its consistency and/or its shape is changed by temperature effects such that the flowable material can distribute itself in the tap opening in a sealing fashion. The material of the plug sleeve is preferably a heat-insulating material, for example, cardboard or wood.

The flowable material is preferably filler sand. After destruction of the sleeve, it forms at the contact surface with the molten mass of metal a sinter layer which seals the tap opening. This provides an additional sealing action. Since the amount of the filler sand in the plug sleeve can be metered and, depending on the wear of the tap hole, can also be varied, the tap hole can be sealed with an optimal amount of sand. This can thus prevent that the sand cannot fill the hole entirely for sealing. Accordingly, problems during opening of the tap hole are circumvented.

Preferably, the introduction means for the plug sleeve is a metal rod or a metal pipe which can be moved through the molten mass to the tap opening. Advantageously, the metal rod or the metal pipe is comprised of members which make it possible to move it by means of an arc-shaped guide out of a horizontal position into a vertical position.

For protecting the metal rod or the pipe against the hot molten mass, they are surrounded by a protective pipe. This protective pipe is also comprised of a material which is resistant for a short period of time relative to the molten mass of metal. Preferably, this material for the plug sleeve and the protective pipe is cardboard which will coke within the molten mass of metal. Also, all other kinds of materials are conceivable which, as a result of the temperature effect of the molten mass of metal, change their consistency, which also includes complete dissolution, or change their shape in that they lose strength.

The filler sand received in the sleeve can contain binders which are destroyed at the temperatures at the level of the molten mass of metal. Moreover, it is conceivable that the filler sand within the sleeve is surrounded by an intermediate protective layer and is vacuum-sealed. This intermediate protective layer is advantageously a foil which dissolves at the temperatures present.

Above the filler sand, a support plate is provided. By means of the support plate, the rod or the pipe can force the filler sand farther downwardly.

A further embodiment of the invention suggests that, in addition to the plug sleeve as a first chamber for receiving a filler material, the hollow space of the protective pipe is used as a second chamber. The second chamber serves as a storage chamber for filler material. The second chamber is filled with filler material especially when the diameter of the tap opening, as a result of wear, has become larger.

When the introduction means for introducing the plug up to the tap opening is a rod, this second chamber is between the rod, which can be axially guided through the protective pipe, and the inner mantle surface of the protective pipe. The amount of filler material in this second chamber can be selected depending on the need. In the case that the means for introducing is a pipe, it penetrates the first chamber with the surrounding protective pipe. The second chamber is formed in the hollow space of the introduction pipe within and above the first chamber. The two embodiments provide that the bottom of the first chamber is provided with a plug, preferably of ceramic material. As a protection of the filler material during penetration of the hot molten mass, the chambers as well as the plug are surrounded by a heat-insulating plug sleeve. This plug is movable as a result of its pressure loading by means of the rod or the pipe. As a result of the movement of the introduction means, the plug is displaced, the sleeve at the bottom is destroyed, and the filler material exits.

The suggested method and the plug exhibit the advantage of a slag-free tapping. When employing the method already in the electric furnace, the secondary metallurgical treatment, in particular, with respect to the current requirements of clean steel is considerably simplified. The uncontrolled aluminum melting loss by entrained slag is prevented. The invention results in savings of deoxidation agent, of the added wires such as CaSi as well as the synthetic slag. Moreover, more beneficial conditions for the desulfurization and degassing are provided. The casting properties are improved.

With the inventive method it is possible to terminate the tapping at a precisely determined nominal tapping weight. With suitable systems the time of introduction of the plug into the tap opening, for example, as a function of the weight of the already tapped molten mass, is controlled. Moreover, the point of introduction can be controlled by means of a bath level measuring system or an early detection system for slag.

BRIEF DESCRIPTION OF THE DRAWINGS

Further details and advantages of the invention result from the claims and the following description. It is shown in:

DESCRIPTION OF PREFERRED EMBODIMENTS

Figure 1:
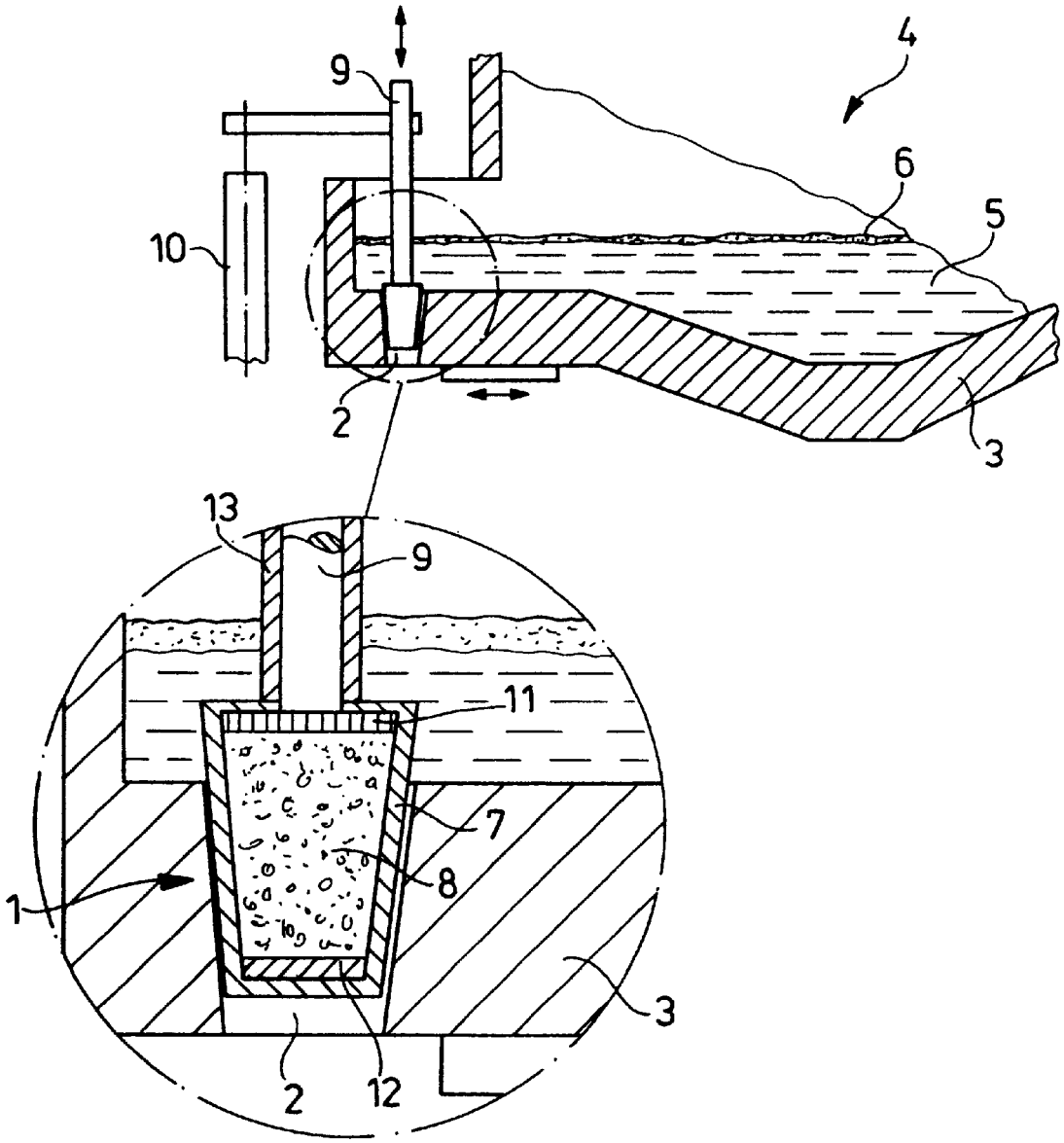
FIG. 1 an enlarged illustration of the plug of the tapping system during the process of immersion into the tap opening of an electric furnace.

FIG. 1 shows in a partial enlargement the plug 1 of the tapping system during the immersion process into the tap opening 2 at the container bottom 3 of an furnace 4. Reference numeral 5 indicates the molten mass of steel, reference numeral 6 the lighter slag.

The plug 1 comprises a sleeve 7 as well as a core 8 of filler sand which is surrounded by the sleeve 7 acting as a protective jacket.

In this embodiment, the plug 1 is introduced, coming from the interior of the container, by means of a metal rod 9 into the tap opening 2 via a lifting system 10.

The metal rod 9 acts via a support grate 11 onto the filler sand 8. The plug 12 forms the closure of the filler sand core 8 relative to the bottom area of the plug sleeve. The diameter of the plug corresponds at least approximately to the diameter of the tap opening 2 at its lower end.

The metal rod 9 is enclosed by a protective pipe 13 for a temporary protection thereof. It can be formed with the sleeve 7 of the plug as a unitary part or can be joined to it. In the first situation, the protective pipe 13 in combination with the sleeve 7 forms the outer sleeve for the metal rod 9 and the filler sand core 8. A protective pipe 13 can be of the same material as the sleeve of the plug. According to the invention, this concerns a material which withstands the temperature effect of the molten mass only for a certain time. In the here disclosed form, the sleeve is comprised of cardboard which as a result of the high temperatures will coke.

During the immersion step of the plug 1 into the tap opening 2 by means of the metal rod 9, the latter presses onto the support grate 11 which then acts, in turn, onto the filler sand core 8 which is supported by the plug 12. In addition, the filler sand can also be vacuum-sealed by means of an intermediate protective foil (not shown) which is dissolved at the temperatures present. Moreover, the sand can be bound with binding agents which are destroyed at high temperatures, for example, a plastic resin.

In addition to or simultaneously with the introduction process of the plug 1 with high speed into the tap opening 2, the tap opening 2 is closed from the outer side of the metallurgical container.

Figure 2:
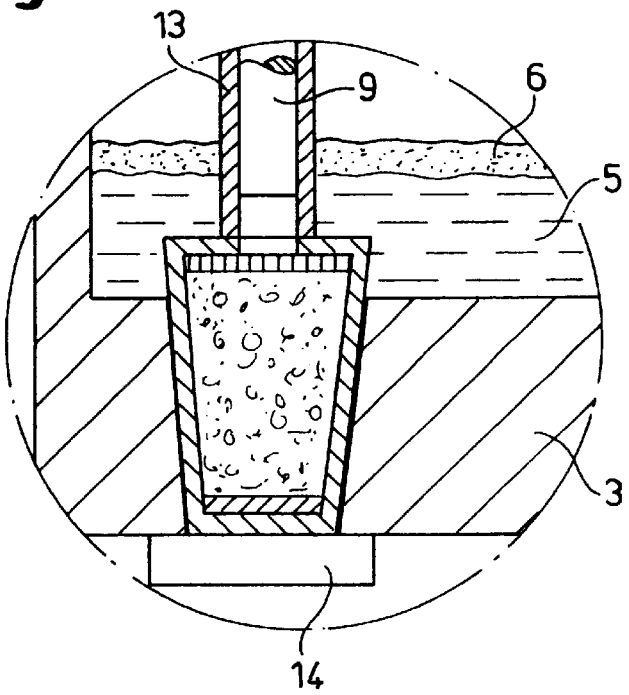
FIG. 2 an enlarged illustration of the plug according to the invention for complete reception in the tap opening.

This closed state is illustrated in FIG. 2. The closure means is a closure plate 14. This can be also any Other type of conventional closure means. After the closing process, the metal rod 9 is separated by automatic detachment of a clamping device (not shown) and is retracted through the interior of the container.

Figure 3:
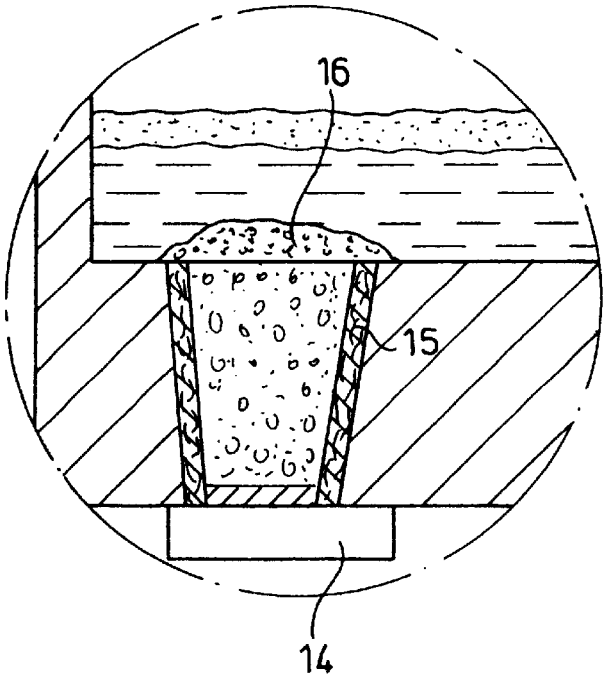
FIG. 3 an enlarged illustration of the plug according to the invention during the process of temperature action on the plug sleeve.

In FIG. 3, the effects resulting from the temperature action can be seen. The plug sleeve 7, comprised of cardboard, is destroyed by coking (15). The metal column of remaining molten mass and slag presses the flowable sand, which is no longer stabilized by a sleeve, in the downward direction and to the side. Accordingly, the sand will expand within the tap opening in a sealing fashion. It is also visible that the material of the protective pipe 13 is completely dissolved. At the contact zone between the filler sand and the liquid metal or the slag, a sinter reaction takes place. This sinter layer 16 means an additional sealing layer. After formation of this seal, the furnace can again be filled with scrap metal for the next batch.

Figure 4:
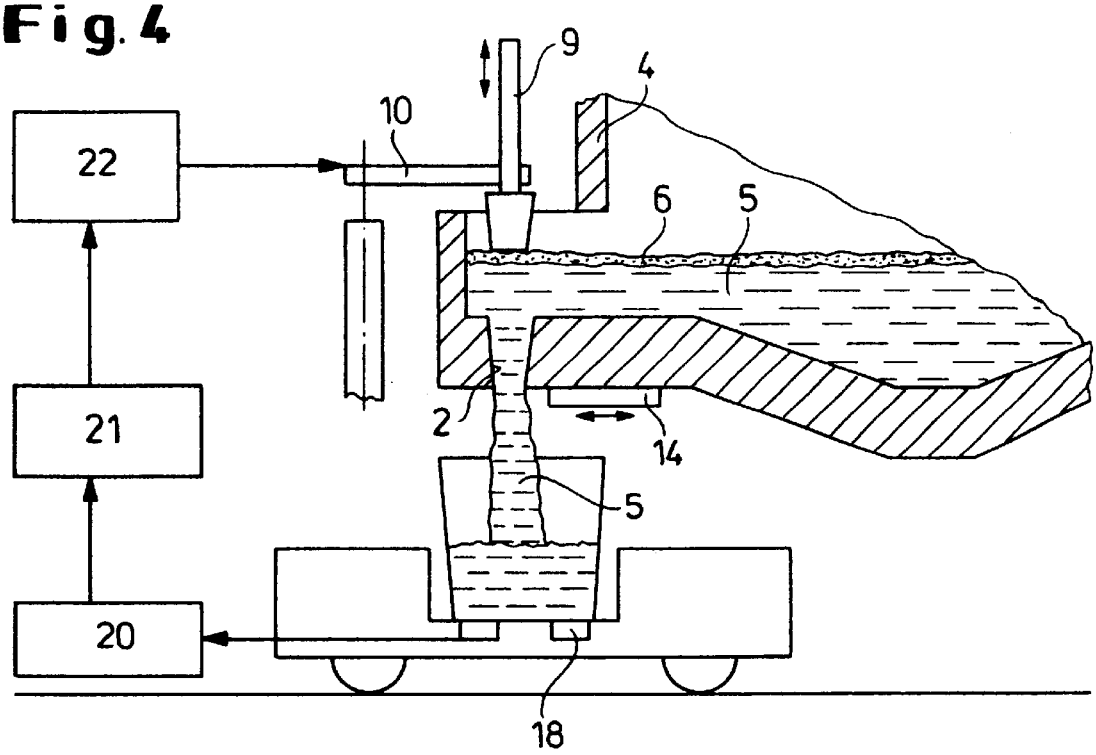
FIG. 4 an illustration of the tapping in an electric furnace with the automatically controlled tapping system.
Figure 5:
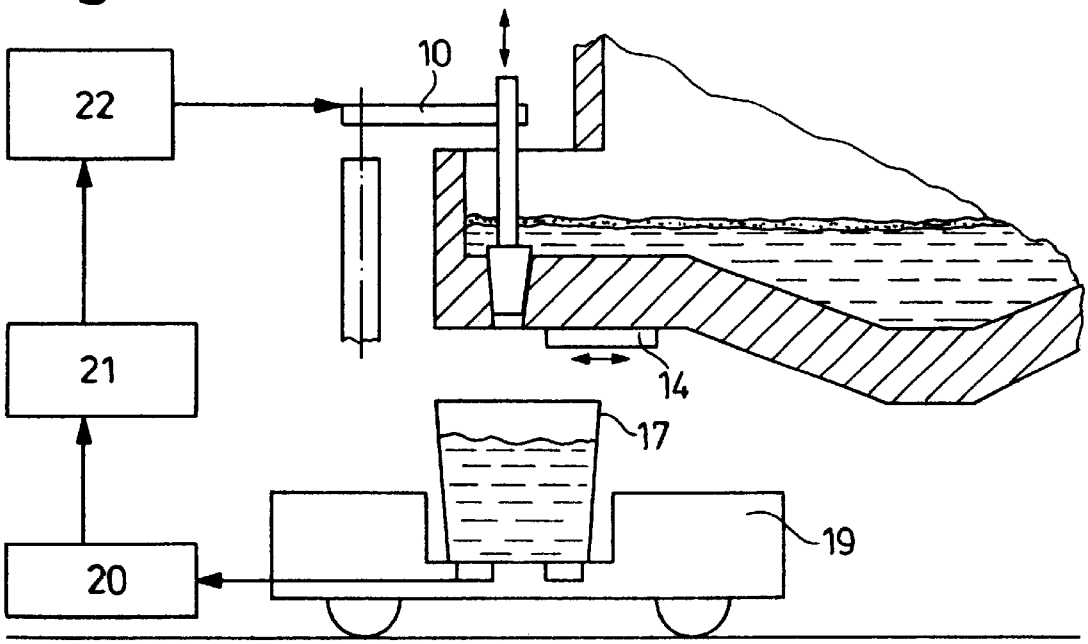
FIG. 5 an illustration of the termination of tapping in an electric furnace with the automatically controlled tapping system.

The FIGS. 4 and 5 show an embodiment of the inventive tapping system in an exemplary fashion for an electric furnace during tapping (FIG. 4) as well as at the end of tapping (FIG. 5). A portion of an electric furnace 4 is illustrated. For tapping of the furnace 4, which in this embodiment cannot be tilted, the closure plate 14 underneath the tap opening 2 is pushed back. The sand which is contained in the tap opening 2 flows out and the molten mass of steel 5 is filled into a ladle 17. During normal operation, the electric furnace is operated with sufficient sump so that during tapping a sufficient bath level remains above the tap opening and no eddies will be formed which could result in an undesirable entrainment of the slag. In order to prevent that at the end of the tapping action the bath level is lowered too much, the furnace 4 is provided with a bay which is positioned at a lower level with a tap hole directly in the furnace or with a greater sump.

The weight of the tapped molten mass is measured by means of a weighing device 18. This weighing device is comprised of weighing cells which are arranged beneath the ladle 17 in the transport carriage 19. The current weight is measured by a measuring system 20 with measuring signals and is supplied to a data processing system 21. After reaching the desired tapping weight, the metal rod 9 of the tapping system is moved by means of a lifting device 10, which is controlled by a plug control system 22, vertically through the interior of the container in order to close the tap opening 2 by means of the plug 1. Such a lifting device is advantageously adapted to the extreme operating conditions. In an alternative embodiment of a tiltable furnace, this lifting device could be arranged at the furnace container or at the tilting platform.

In addition, for example, for fluctuations of the bath level, a known early detection mechanism for slag can be provided. It is connected to the data processing system 21 and the plug control system 22. Even when the desired weight of the molten mass of steel has not yet been reached, the plug is moved into the tab opening as soon as the entrainment of slag is detected. With the fast reaction of the tapping system according to the invention it is possible to prevent slag from flowing out.

Figure 6:
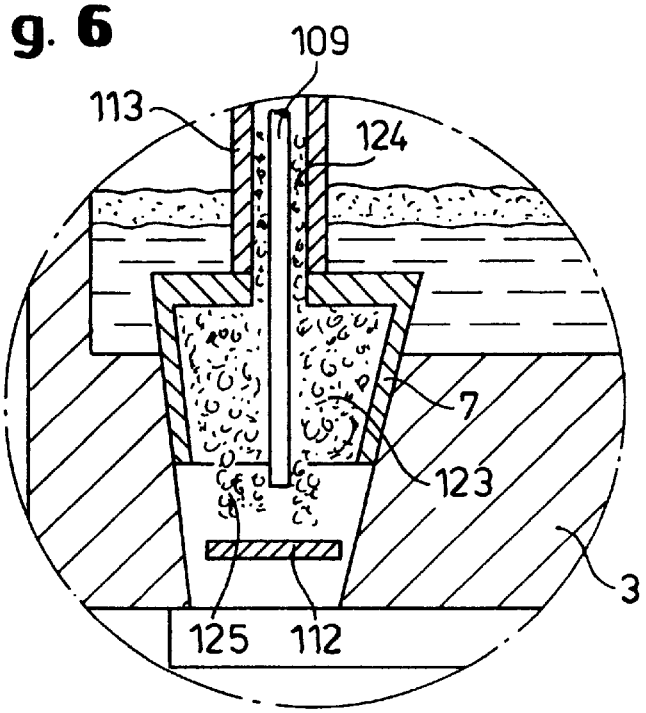
FIG. 6 an enlarged representation of one embodiment of the plug according to the two-chamber system shown introduced into a tap opening of a metallurgical container.

FIG. 6 shows a first embodiment of the plug according to the two-chamber system. The components which are identical to those of FIGS. 1 through 3 are identified with corresponding reference numerals. The FIGS. 6 and 7 do not show the initial state of the plug but the inserted state in the tab opening. In the initial state, the plug is comprised of a first chamber surrounded by cardboard and a second chamber which is also surrounded by cardboard. The bottom of the first chamber is detachably closed off by a plug which is positioned within the protective sleeve.

According to FIG. 6, the first chamber is identified by 123, the second chamber by 124. The second chamber extends between the inner mantle surface of the protective pipe 113 adjoining the plug sleeve 7 of the first chamber 123 and the outer surface of the metal rod 109. For emptying the chamber system, the plug 112 is detached from the bottom of the first chamber by pressure loading via the rod 109 and experiences a drive movement in the direction toward the outer container side. As a result, the bottom sleeve (no longer shown) ruptures and the filler sand 125 flows out. It is also conceivable that the plug is continuously moved by contact with the axially movable rod. The diameter of the plug is sized for the two-chamber system such that a guiding within the narrowing tap opening is possible.

Figure 7:
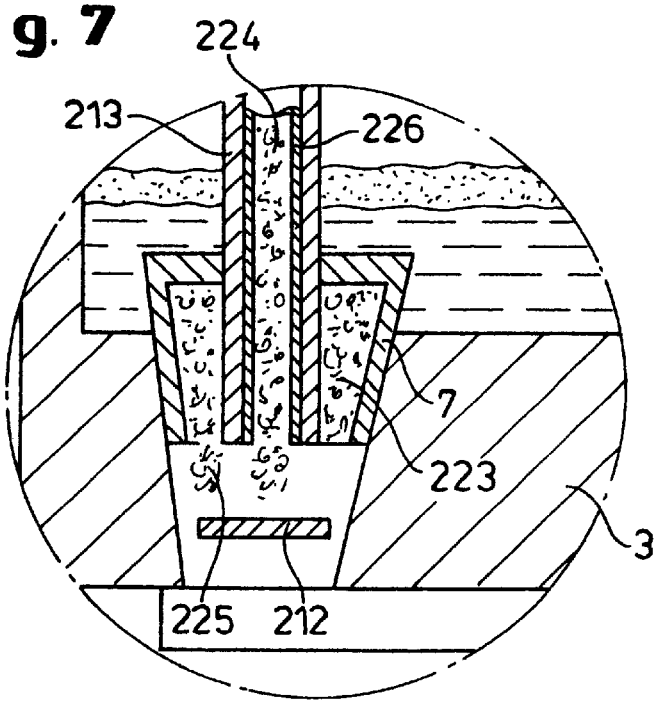
FIG. 7 an enlarged illustration of a further embodiment of the plug according to the two-chamber system shown introduced into a tap opening of a metallurgical container.

According to the embodiment of FIG. 7, the metal rod is replaced by a hollow pipe 226. The protective pipe 213 receives this pipe 226 and penetrates the part of the plug sleeve 7 covering the upper side of the chamber 223 and thus the first chamber 223. The second chamber 224 is formed in the hollow space of the introduction pipe 226. With an axial movement of the introduction pipe 226 toward the protective pipe 213, the plug 212 experiences an impact movement and tears the bottom sleeve (no longer illustrated). Filler sand 225 flows out. Should the plug be moved by a contact movement, a backward movement of the pipe 213 is required for the filler sand to flow out of the second chamber.

What is claimed is:

1. A method for sealing a tap opening in a metallurgical container, the method comprising the steps of:

providing a plug, comprised of a plug sleeve and a refractory flowable material;

providing a metal rod or a metal pipe surrounded by a protective pipe, respectively, wherein the plug sleeve and the protective pipe are made of a material resistant with respect to a molten mass of metal in the metallurgical container only for a short period of time, wherein the material is a temporarily heat-insulating material which cokes within the molten mass of metal and is selected from the group consisting of cardboard or wood;

controlling the time of introduction of the plug sleeve based on measured parameters of the molten mass;

introducing the plug into the tap opening by guiding the plug with the metal rod or the metal pipe through the molten mass in the metallurgical container, wherein the plug sleeve changes by temperature action of the molten mass of metal such that the flowable material is distributed in the tap opening and seals the tap opening; and closing off the tap opening from the exterior of the metallurgical container and coking and destroying the plug sleeve in the tap opening as well as the protective pipe.

2. The method according to claim 1, wherein the step of controlling is carried out semi-automatically.

3. The method according to claim 1, wherein the step of controlling is carried out manually.

4. A tapping system for sealing a tap opening of a metallurgical container according to the method of claim 1, the tapping system comprising:

a plug, comprised of a plug sleeve, matching the tap opening of the metallurgical container, and a refractory flowable material contained in the plug sleeve for sealing the tap opening;

the plug further comprising a metal rod or a metal pipe surrounded by a protective pipe, respectively;

wherein the plug sleeve and the protective pipe are made of a material resistant with respect to a molten mass of metal in the metallurgical container only for a short period of time, wherein the material is a temporarily heat-insulating material which cokes within the molten mass of metal and is selected from the group consisting of cardboard or wood;

wherein the plug is guided into the tap opening through the molten mass in the metallurgical container by the metal rod or the metal pipe; and wherein the plug sleeve changes by temperature action of the molten mass of metal such that the flowable material is distributed in the tap opening and seals the tap opening.

5. The method according to claim 1, wherein the flowable material in the form of filler sand forms at the contact surface with the molten mass of metal a sinter layer (16) sealing the tap opening after decomposition of the sleeve.

6. The method according to claim 1, wherein in the step of controlling the weight of the already tapped molten mass is determined and the plug is introduced when a set weight is reached.

7. The method according to claim 1, wherein in the step of controlling a slag detection system is provided and the plug is introduced when the presence of slag is detected by the slag detection system.

8. The method according to claim 1, wherein in the step of controlling the bath level of the molten mass is sensed in the melting apparatus and the plug is introduced when a set bath level is reached.

9. The method according to claim 1, wherein the step of controlling is carried out automatically.

10. The tapping system according to claim 4, comprising automatically controllable means (9, 10) for introducing the plug sleeve (7) into the tap opening.

11. The tapping system according to claim 4, wherein the metal rod or the metal pipe is comprised of members connected to an arc-shaped guide configured to move the metal rod or the metal pipe out of the horizontal position into the vertical position.

12. The tapping system according to claim 11, wherein the metal rod or the metal pipe act via support means onto the refractory flowable material.

13. The tapping system according to claim 4, wherein in addition to the plug sleeve (7) as a first chamber (123, 223) for receiving the refractory flowable material, the protective pipe has a hollow space (113, 213) used as a second chamber (124, 224) for receiving the refractory flowable material.

14. The tapping system according to claim 13, wherein the protective pipe (113) is arranged at the plug sleeve (7) and the metal rod (109), penetrating the first and second chambers, is movable axially to the protective pipe.

15. The tapping system according to claim 13, wherein the protective pipe (213) penetrates the plug sleeve (7) and the metal pipe (226) receives additional refractory flowable material and is axially moveable relative to the protective pipe (213).

16. The tapping system according to claim 13, wherein a plug (113, 212) detachably closes off a bottom side of the first chamber (123, 223) and is moveable by pressure loading through the metal rod (109) or the metal pipe (226) for opening the first and second chambers and for allowing the refractory flowable material to flow out.

17. The tapping system according to claim 13, wherein the refractory flowable material is filler sand which contains a binding agent which decomposes at the temperatures of the molten mass of metal and wherein the filler sand within the protective pipe is surrounded by an intermediate protective layer and is vacuum-sealed.

* * * * *